United States Patent [19]

Raab et al.

[11] Patent Number: 4,556,764

[45] Date of Patent: Dec. 3, 1985

[54] SLIDE ACTION ELECTRICAL SWITCHES

[75] Inventors: Andrew F. Raab, Morton Grove; Albert R. Cobb, III, Glenview, both of Ill.

[73] Assignee: Indak Manufacturing Corp., Northbrook, Ill.

[21] Appl. No.: 708,252

[22] Filed: Mar. 5, 1985

[51] Int. Cl.[4] ..... H01H 15/00; H01H 1/00

[52] U.S. Cl. ..... 200/16 C; 200/284

[58] Field of Search ..... 200/11 D, 11 DA, 11 G, 200/11 J, 11 K, 11 TW, 16 C, 16 D, 16 F, 284, 303

[56] References Cited

U.S. PATENT DOCUMENTS

| | | | |
|---|---|---|---|
| 3,462,564 | 8/1969 | Bedocs . | |
| 3,721,779 | 3/1973 | Raab | 200/16 C |
| 3,942,555 | 3/1976 | Raab et al. | 137/625.2 |
| 4,054,761 | 10/1977 | Raab et al. | 200/16 C |
| 4,072,839 | 2/1978 | Spedale | 200/284 X |
| 4,126,153 | 11/1978 | Raab | 137/353 |
| 4,168,405 | 9/1979 | Raab et al. | 200/1 V |
| 4,251,698 | 2/1981 | Raab et al. | 200/61.86 |
| 4,448,390 | 5/1984 | Halstead et al. | 251/176 |

FOREIGN PATENT DOCUMENTS

| | | | |
|---|---|---|---|
| 769174 | 10/1967 | Canada | 200/284 |

*Primary Examiner*—J. R. Scott

*Attorney, Agent, or Firm*—Burmeister, York, Palmatier, Hamby & Jones

[57] ABSTRACT

An electrical switch is disclosed, including contact plates having fixed contact portions which are slidably engageable by at least one movable contactor. At least one plate has a submarining crossover portion bent into a U-shape and extending across an overlapping portion of another plate but in a different plane to obviate any electrical contact between the submarining crossover portion and the overlapping portion. The plates may be mounted on an insulating casing wall having a recess for receiving the submarining crossover portion. The plates may have first end portions formed as L-shaped hooks inserted into slots formed in the casing wall. At their opposite ends, the plates may have second end portions formed as L-shaped terminal portions including terminal flanges and terminal prongs. Such prongs may be received in notches formed in a casing end wall, and may be retained in such notches by tooth-like projections on a casing cover. Such prongs may be retained against endwise movement by such flanges, engaging the inner side of the casing end wall, and tabs on such prongs, engaging the outer side of the end wall.

36 Claims, 62 Drawing Figures

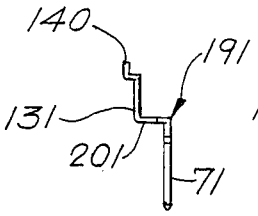
FIG. 26
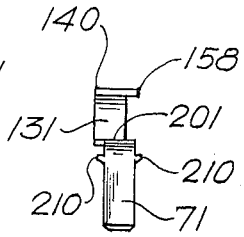
FIG. 27
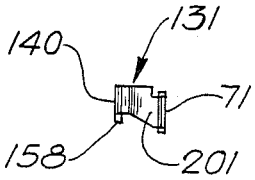
FIG. 28
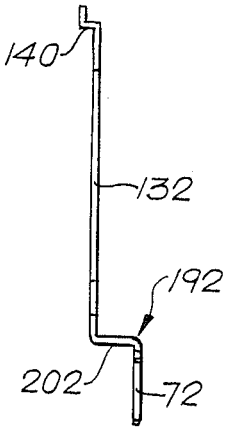
FIG. 29
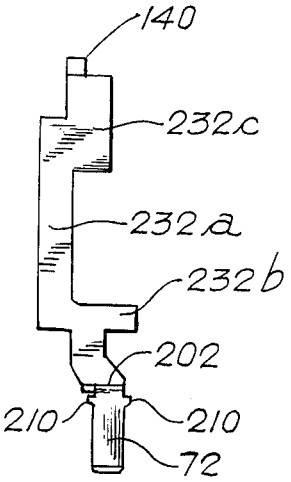
FIG. 30
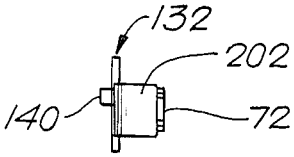
FIG. 31
FIG. 32
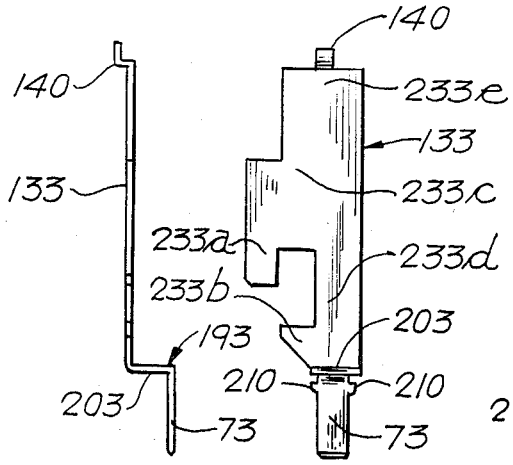
FIG. 33
FIG. 35
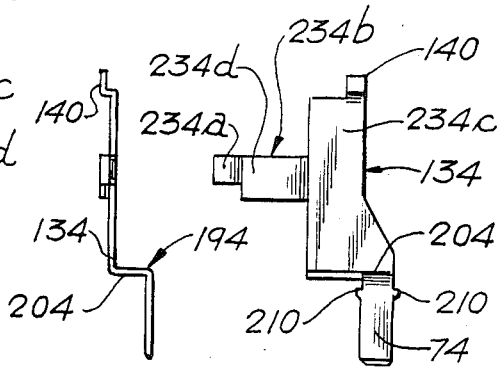
FIG. 36
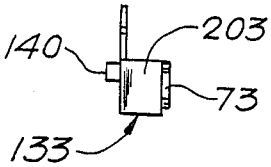
FIG. 34
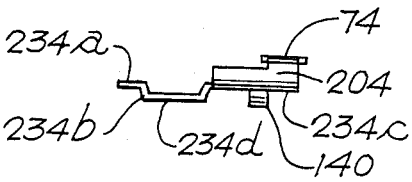
FIG. 37

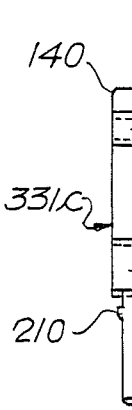
FIG. 47
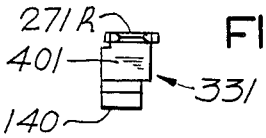
FIG. 49
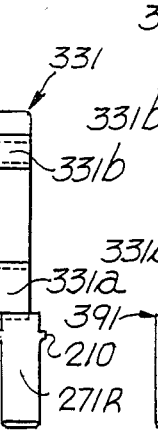
FIG. 48
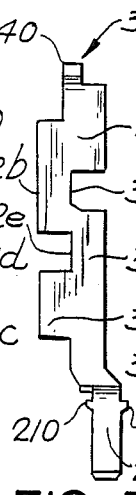
FIG. 50
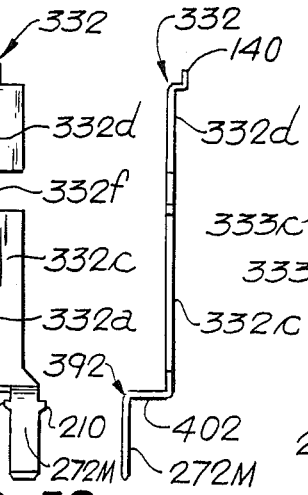
FIG. 51
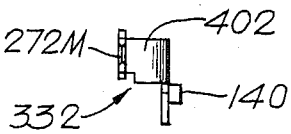
FIG. 52
FIG. 53
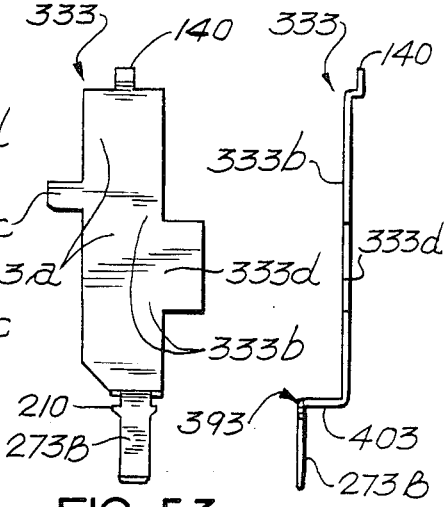
FIG. 54
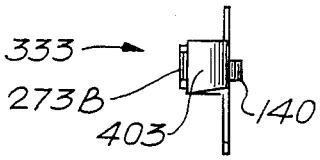
FIG. 55
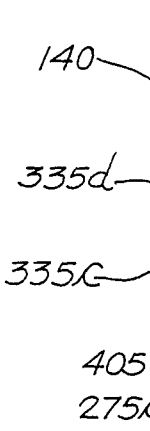
FIG. 56
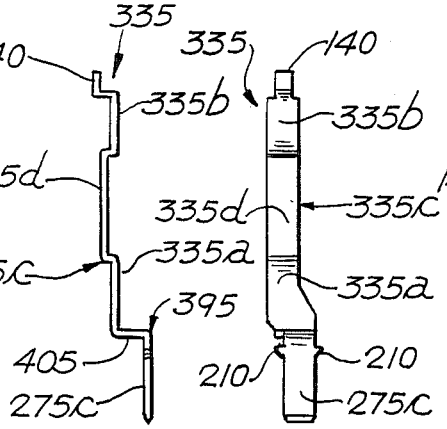
FIG. 57
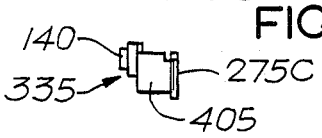
FIG. 58
FIG. 59
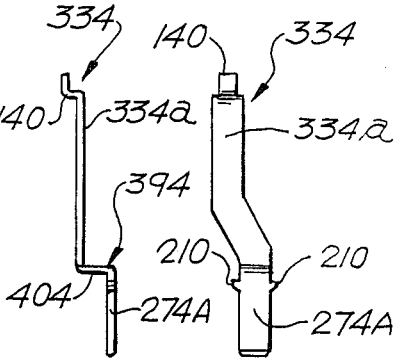
FIG. 60
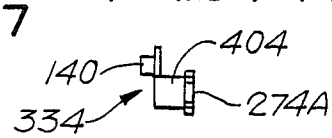
FIG. 61

SLIDE ACTION ELECTRICAL SWITCHES

FIELD OF THE INVENTION

This invention relates to slide action electrical switches, particularly multiposition switches which are useful for controlling the various functions of automotive heating, ventilating and air conditioning systems.

BACKGROUND OF THE INVENTION

Slide action electrical switches, intended particularly for automotive service, have been disclosed and claimed in prior U.S. patents, assigned to the assignee of the present application. Such prior U.S. patents include Bedocs U.S. Pat. Nos. 3,462,564, issued Aug. 19, 1969; Raab 3,721,779, issued Mar. 20, 1973; Raab and Cobb 3,942,555, issued Mar. 9, 1976; Raab and Halstead 4,054,761, issued Oct. 18, 1977; Raab 4,126,153, issued Nov. 21, 1978; Raab and Halstead 4,251,698, issued Feb. 17, 1981; and Halstead and Black 4,448,390, issued May 15, 1984. In several of these prior patents, the disclosed slide action electrical switches are combined with fluid control devices, such as vacuum control valves or switches The present invention relates to important improvements in slide action electrical switches of the general construction disclosed in the above-mentioned U.S. patents. A slide action switch of such general construction includes fixed contact plates or bars having fixed contact portions which are slidably engageable by at least one movable contactor, usually mounted on a movable insulating carriage. The contact plates are typically mounted on an insulating wall or board in a casing having means for guiding the movement of the carriage. Typically, the contact plates are secured to the insulating wall by means of rivets. The use of rivets complicates the assembly of such switches and adds to the cost of such assembly.

One object of the present invention is to provide a new and improved slide action electrical switch in which the contact plates and the casing are constructed and arranged to securely retain and accurately locate the contact plates in the casing, without the use of any rivets or other fasteners, so that the assembly of the switch is greatly facilitated, while the cost of the switch is significantly reduced.

In some slide action electrical switches, it becomes desirable to provide a crossover between two of the contact plates, without any electrical connection between the plates. This general problem has been dealt with in a very limited manner in the slide action electrical switch disclosed in the above-mentioned Raab U.S. Pat. No. 4,126,153, in which a bridging flange 130 is bent downwardly from the contact plate 112, so as to provide an electrical connection between the contact portions 112A and 112B, while avoiding any electrical contact with the contact portion 111B on the adjacent plate 111. In this construction, the bridging flange 130 takes up considerable room and is not conducive to a compact switch construction. Moreover, the provision of the bridging flange is complex and costly, so that this construction has a limited usefulness.

Another object of the present invention is to provide a new and improved slide action electrical switch, having a new and improved crossover construction, whereby crossovers can be effectuated between the contact plates, without any electrical contact therebetween, at virtually any desired location or situation, yet at low cost and with a high degree of compactness.

SUMMARY OF THE INVENTION

In accordance with the present invention, the objective of producing an improved crossover construction may be achieved by providing an electrical switch, comprising an insulating casing, a plurality of fixed contact plates mounted in said casing and having a plurality of fixed contact portions, an insulating carriage mounted in said casing, said casing having means for guiding said carriage for movement along a predetermined path, at least one electrically conductive contactor mounted on said carriage for movement therewith along said path and for selective engagement with certain of said contact portions, said plates including at least a first plate having a U-shaped formation bent therefrom and extending between different portions of said first plate, said U-shaped formation including a substantially flat submarining crossover portion which is offset into a plane which is different from but substantially parallel with the plane of said different portions of said first contact plate, said plates including at least a second plate having an overlapping portion which overlaps with and is crossed by said submarining crossover portion but is in a different plane from the plane of said submarining crossover portion and is spaced therefrom while being substantially parallel therewith to obviate any electrical contact between said submarining crossover portion and said overlapping portion.

The overlapping portion may also be one of the contact portions of the second plate.

The switch may include a plurality of such U-shaped formations having corresponding submarining crossover portions, on one or more of the contact plates. There may also be a plurality of such overlapping portions which overlap the corresponding submarining crossover portions.

The casing may be formed with one or more recesses for receiving one or more submarining crossover portions.

The casing may have an insulating wall for supporting the fixed contact plates. Such wall may have one or more recesses therein for receiving one or more of the submarining crossover portions.

The submarining crossover portion may extend between a contact portion and another portion of the first plate. The overlapping portion may extend between different contact portions of the second plate.

The contact plates may have respective terminal prongs formed in one piece therewith. The submarining crossover portion may extend between a first contact portion and another portion thereof, affording a connection to the corresponding terminal prong. The overlapping portion of the second plate may afford a connection between second and third contact portions thereof while also affording a connection to the terminal prong of the second plate.

The contactor may have a contact point which is movable into engagement with the first, second and third contact portions at different positions of the contactor along its path of movement.

In another embodiment, the submarining crossover portion may extend between first and second contact portions of the first plate. The overlapping portion of the second plate may also constitute a third contact portion. The contactor may comprise a contact point which is engageable with the first, second and third contact portions at different positions of the contactor, along its path of movement.

The submarining crossover portion may afford a connection between first and second contact portions thereof while also affording a connection to the terminal prong of the first plate, by way of the second contact portion thereof.

In accordance with the present invention, the objective of eliminating the use of rivets and other fasteners may be achieved by providing an electrical switch, comprising an insulating casing having a body with a supporting wall, said casing also having a cover, a plurality of fixed contact plates mounted in said casing along said supporting wall, said contact plates having a plurality of fixed contact portions, an insulating carriage mounted in said casing, said casing having means for guiding said carriage for movement along a predetermined path, and at least one electrically conductive contactor mounted on said carriage for movement therewith along said path and for selective engagement with certain of said contact portions, said supporting wall of said casing having a plurality of slots therein, said plates having respective first end portions formed as generally L-shaped hooks for reception in said respective slots to retain said first end portions against said supporting wall, said plates having respective second end portions formed as respective electrical terminals, said body of said casing having nest means forming respective nests for receiving said respective terminals, said cover and said body having fastener means for fastening said cover to said body, said cover having retainer elements for engaging and retaining said terminals in said nests.

Each L-shaped hook may comprise a first flange portion bent from the corresponding contact plate and extending through the corresponding slot, as well as a second flange portion bent from the first flange portion and extending behind the outer side of the supporting wall. The contact plates may be mounted along the inner side of the wall.

The supporting wall may have a plurality of enclosure flanges projecting from the outer side of the wall and extending around the slots and also around adjacents portions of such outer side to afford electrical insulation for the L-shaped hooks.

The nests for the terminals may take the form of recesses or notches in end wall means on the body of the casing. The retainer elements may comprise projections on the cover, for engaging and retaining the terminals in such recesses.

Such projections may be tooth-like in shape and may extend into portions of the recesses or notches, for retaining the terminals therein.

The terminals may have inner and outer locating means for overlapping the inner and outer sides of the end wall means to locate the terminals against substantial endwise movement.

The terminals may have respective flanges constituting the inner locating means, as well as respective lateral projections constituting the outer locating means. Such lateral projections may be in the form of tabs.

The terminal may be generally L-shaped and may comprise respective terminal flanges bent from the plates, as well as terminal prongs bent from such terminal flanges. The terminal prongs may be received in the recesses or notches in the end wall means of the casing. The terminal flanges may engage the inner side of the end wall means and may constitute the inner locating means. The outer locating means may comprise respective lateral projections or tabs on the terminal prongs and spaced from the terminal flanges, for engaging the outer sides of the end wall means.

The fastener means may be in the form of latching snap fastener elements on the cover and the body of the casing.

With this construction, the slide action switch may be assembled very easily, without the use of rivets or any other fasteners. The contact plates are simply laid into the body by inserting the L-shaped hooks into the slots, pressing the terminal prongs into the notches or nests, and pressing the cover and the body together, with the carriage and the contactor positioned therebetween. The latching fastener elements simply snap together. In some cases, the switch may include a plurality of contactors and carriages.

A variety of different switches can be produced by using different sets of contact plates and different contactor arrangements. The contact plates may include one or more of the submarining crossover portions, to provide a variety of crossover arrangements.

BRIEF DESCRIPTION OF THE DRAWINGS

Further objects, advantages and features of the present invention will appear from the following detailed description, taken with the accompanying drawings, in which:

FIGS. 26, 27 and 28 are side, front and end views of the first contact plate as removed from the switch of FIGS. 1–6, such plate being the first from the left as shown in FIG. 6.

FIGS. 29, 30 and 31 are side, front and end views of the second contact plate, shown second from the left in FIG. 6.

FIGS. 32, 33 and 34 are side, front and end views of the third contact plate, shown third from the left in FIG. 6.

FIGS. 35, 36 and 37 are side, front and end views of the fourth contact plate, shown fourth from the left in FIG. 6.

FIGS. 47, 48 and 49 are front, side and end views of the first contact plate, shown first from the left in FIG. 43.

FIGS. 50, 51 and 52 are front, side and end views of the second contact plate, shown second from the left in FIG. 43.

FIGS. 53, 54 and 55 are front, side and end views of the third contact plate, shown third from the left in FIG. 43.

FIGS. 56, 57 and 58 are side, front and end views of the fourth contact plate, shown fourth from the left in FIG. 43.

FIGS. 59, 60 and 61 are side, front and end views of the fifth contact plate, shown fifth from the left in FIG. 43.

DETAILED DESCRIPTION OF ILLUSTRATIVE EMBODIMENTS

It will be understood that directional words, as used in this application, such as the words front, rear, side, top, bottom, end, above, below, over and under, are used in a relative sense, and that the electrical switches of the present invention can be utilized in any position or orientation, as desired.

The drawings show two electrical switches to be described as illustrative embodiments of the present invention. The first embodiment is shown in FIGS. 1–37, while the second embodiment is shown in FIGS. 38–61. The two embodiments have a great deal in common. Thus, FIGS. 10–25 are fully applicable to both embodiments. The components shown in these figures are employed in both embodiments. These components include the body of the casing, the cover of the casing, the movable carriage, and the contactor. The second embodiment employs two such contactors.

Figure 5:
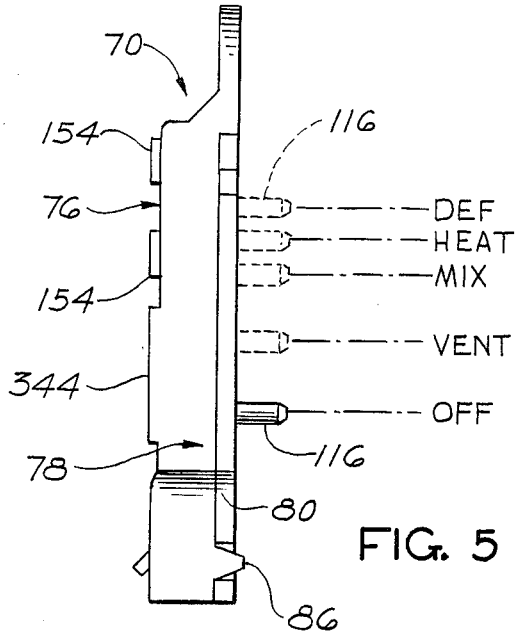
FIG. 5 is a side view, showing the various operating positions of the switch of FIG. 1.

As just indicated, FIGS. 1–37 illustrate a slide action electrical switch 70, to be described as a first illustrative embodiment of the present invention. The switch 70 is particularly useful for controlling the heating and ventilating system of an automobile or some other automotive vehicle. As shown in FIG. 5, the switch 70 may have five operating positions, labeled OFF, VENT, MIX, HEAT and DEF(defrost).

Figure 3:
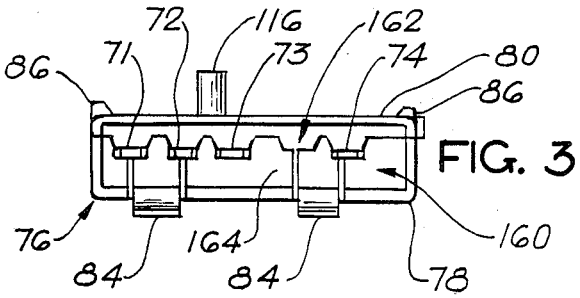
Figure 6:
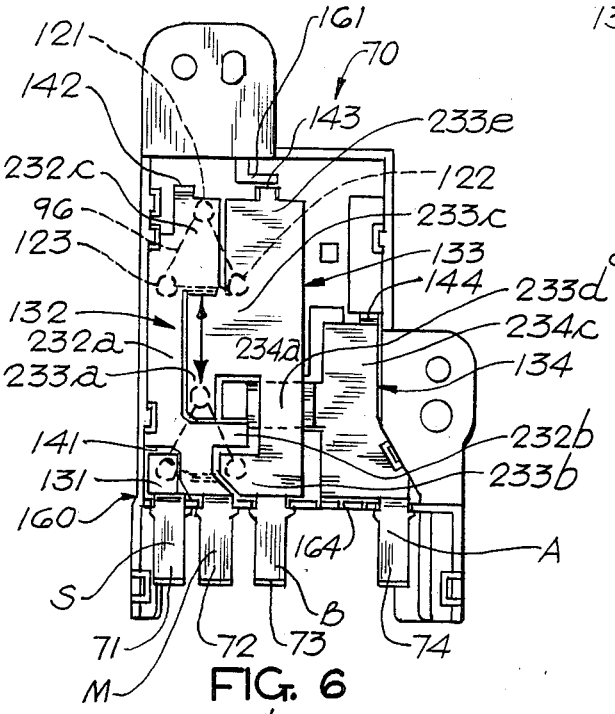
FIG. 6 is a front view, similar to FIG. 2, but with the cover and the carriage removed, the extreme positions of the movable contactor being shown in broken lines.
Figure 8:
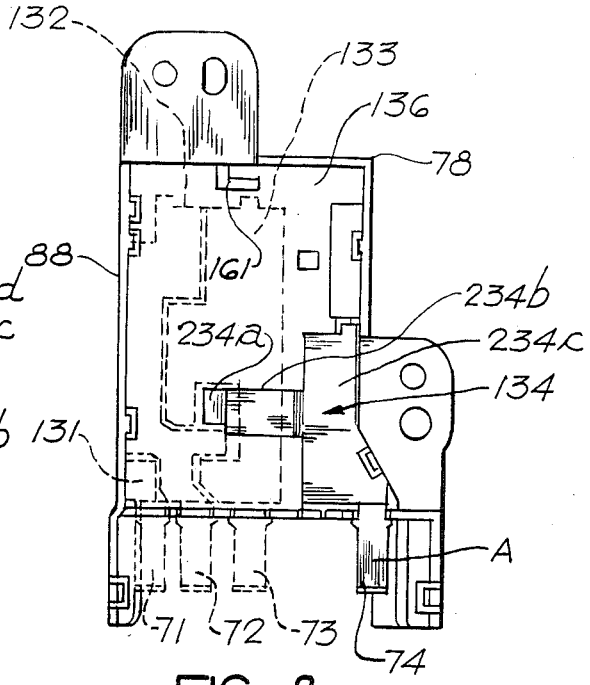
FIG. 8 is a front view, similar to FIG. 6, but with three of the four contact plates removed, the removed contact plates being shown in broken lines, while the remaining contact plate, having a submarining crossover portion, is shown in full lines.

As shown most clearly in FIGS. 3 and 6, the slide switch 70 has four electrical terminal prongs 71, 72, 73 and 74. For controlling the automotive heating and ventilating system, the terminal prongs may be connected to the following circuits of the system: 71, SHUT OFF DOOR (S); 72, MOTOR (M); 73, BATTERY (B); 74, AUXILIARY DOOR (A). As indicated parenthetically in the preceding sentence, the four terminal prongs 71, 72, 73 and 74 may also be identified by the capital letters S, M, B and A, representing the circuits to which the terminal prongs are normally connected. These capital letters have been added to FIG. 6.

The electrical slide switch 70 is adapted to establish the following circuits in its five operating positions: OFF, B+S; VENT, B+M+A; HEAT, B+M; MIX, B+M; DEF, B+M. It will be understood that B+S means that the BATTERY circuit is connected to the SHUT OFF DOOR circuit; B+M+A means that the BATTERY circuit is connected to the MOTOR and AUXILIARY DOOR circuits; and B+M means that the BATTERY circuit is connected to the MOTOR circuit. The four terminal prongs 71–74 are adapted to receive a suitable electrical connector or plug, whereby the switch 70 is connected into the various wiring circuits of the heating and ventilating system.

As shown in FIGS. 1–5, the switch 70 has a casing 76 which comprises a body 78 and a cover 80, both preferably made of moldable resinous plastic materials, to provide mechanical support and electrical insulation. Other suitable materials may be employed.

The terminal prongs 71–74 are accessible through an opening 82 in one end of the casing 76. The opening 82 is adapted to receive the previously mentioned electrical connector or plug, not shown. The body 78 of the casing 76 may include a pair of latching spring clips 84, for latching engagement with the plug, to secure it to the casing 76.

Figure 1:
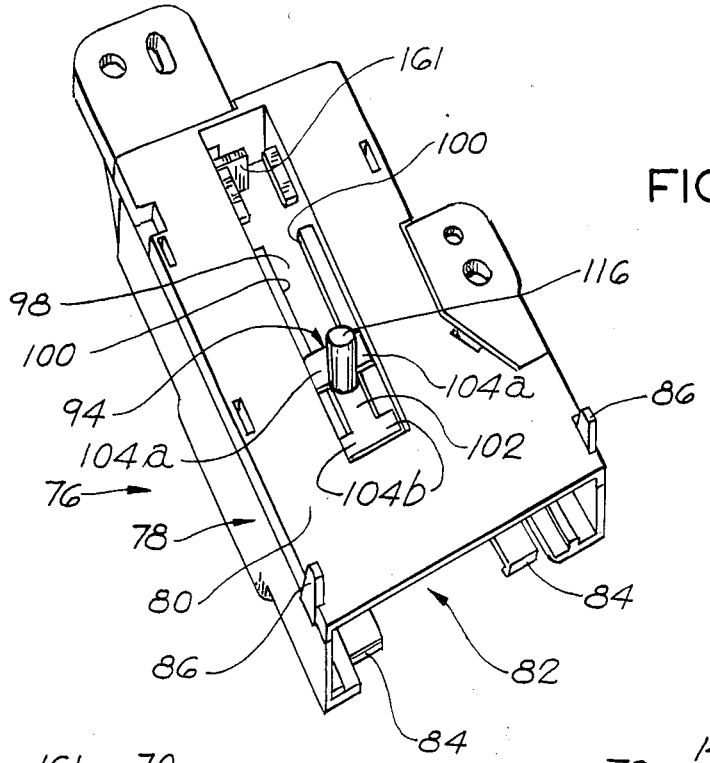
FIG. 1 is a perspective view of a slide action electrical switch, to be described as an illustrative embodiment of the present invention.
Figure 2:
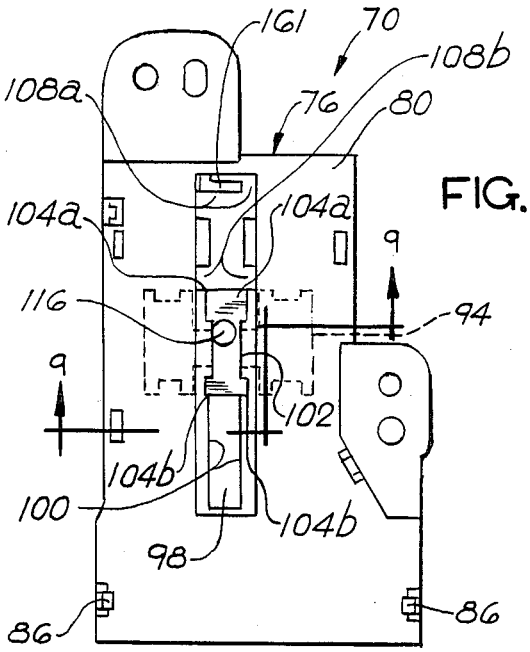
FIGS. 2, 3 and 4 are front, rear and end views of the switch of FIG. 1.
Figure 4:
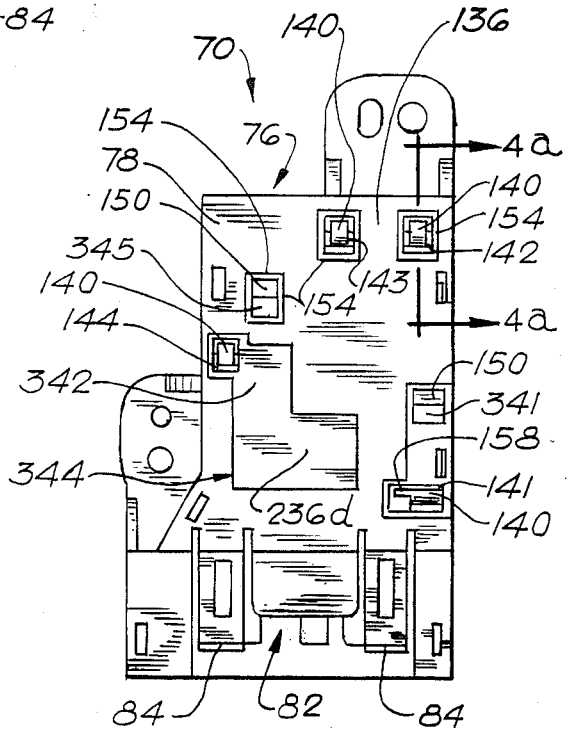

The casing 76 is provided with means for securing or fastening the body 78 and the cover 80 together. For ease of assembly, it is preferred to employ latching snap fastener elements for this purpose, so that the body 78 and the cover 80 can simply be pressed together manually, without the use of any tools or machinery. As shown in FIGS. 1–3, the body 78 is provided with a pair of latching tabs 86 which snap in front of the cover 80. The latching tabs 86 extend upwardly from a side wall portion 88 of the body 78. Such side wall portion 88 extends around the perimeter of the body 78, except for the opening 82.

Figure 10:
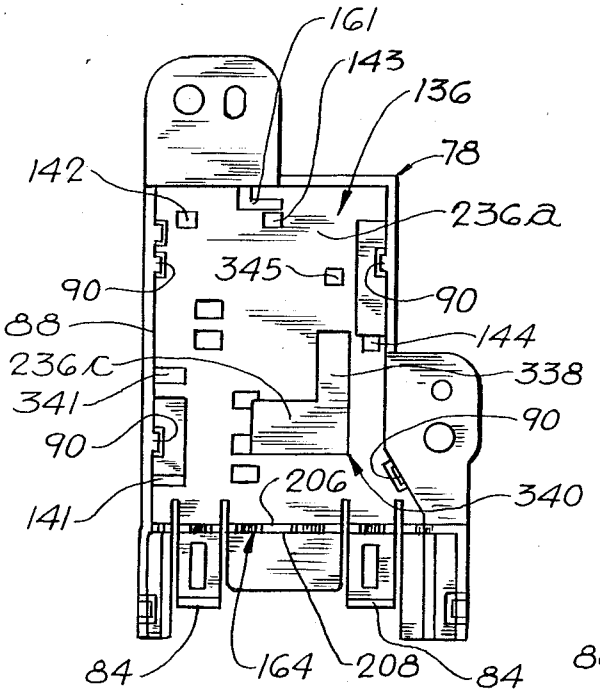
FIG. 10 is a front view, similar to FIG. 8, but showing the body of the casing, with all of the other components removed.
Figure 17:
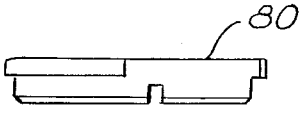
FIGS. 14, 15, 16, 17 and 18 are front, side, rear, top and bottom views of the cover for the casing, removed from the switch of FIGS. 1–5.
Figure 15:
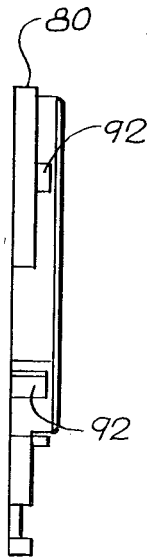
Figure 25:
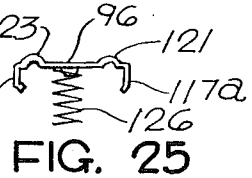
FIGS. 23, 24 and 25 are front, rear and side views of the conductive contactor, as removed from the switch of FIGS. 1–5.
Figure 14:
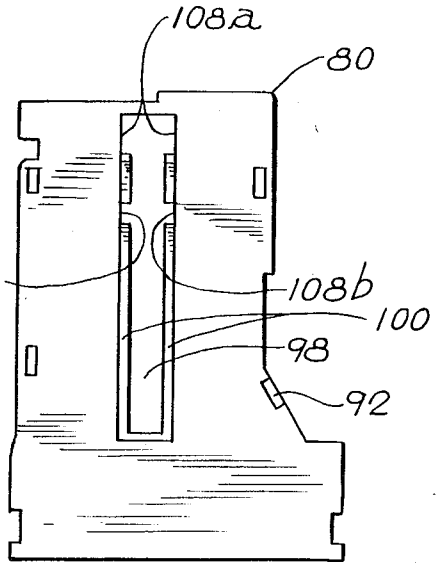
Figure 23:
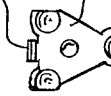
Figure 24:
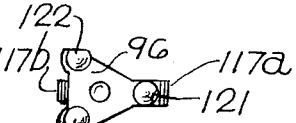
Figure 22:
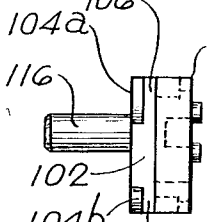
FIGS. 19, 20, 21 and 22 are enlarged rear, bottom, front and side views of the carriage, as removed from the switch of FIGS. 1–5, FIG. 20 being partly in section along the line 20—20 in FIG. 21.
Figure 19:
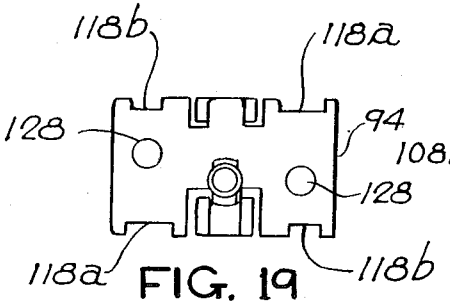
Figure 20:
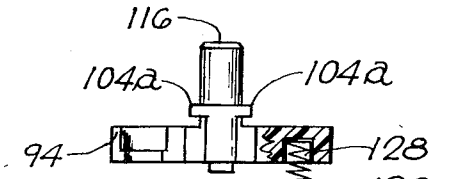
Figure 21:
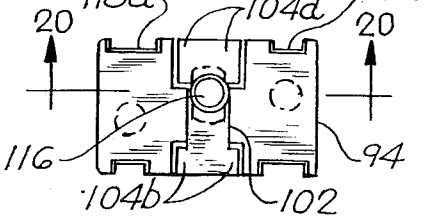
Figure 38:
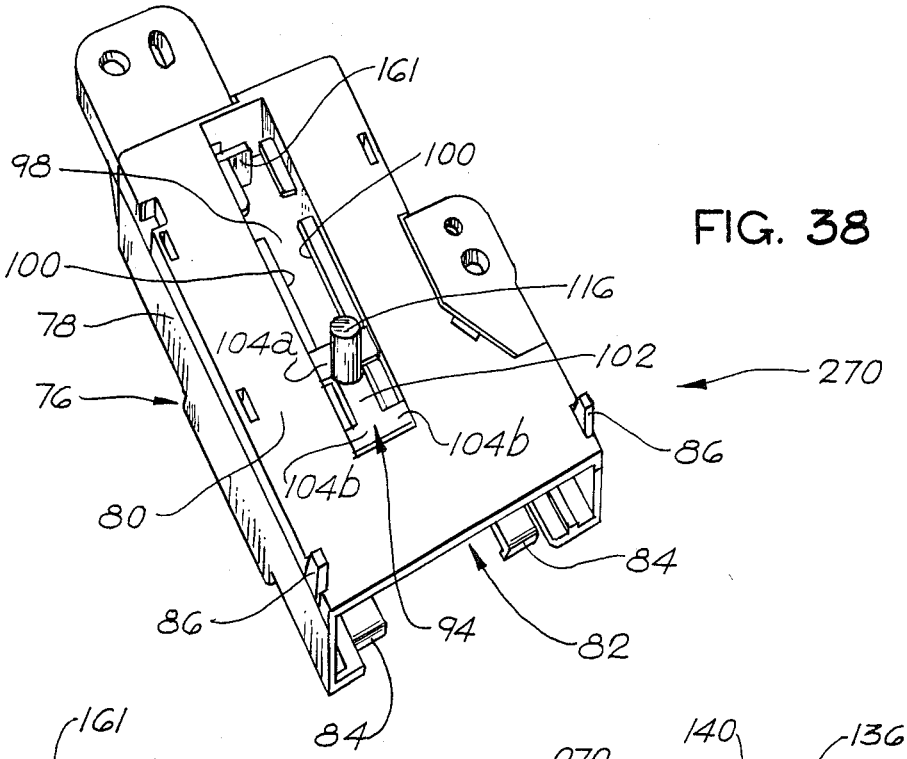
FIG. 38 is a perspective view, similar to FIG. 1, but showing a modified slide action electrical switch, to be described as a second embodiment of the present invention.
Figure 39:
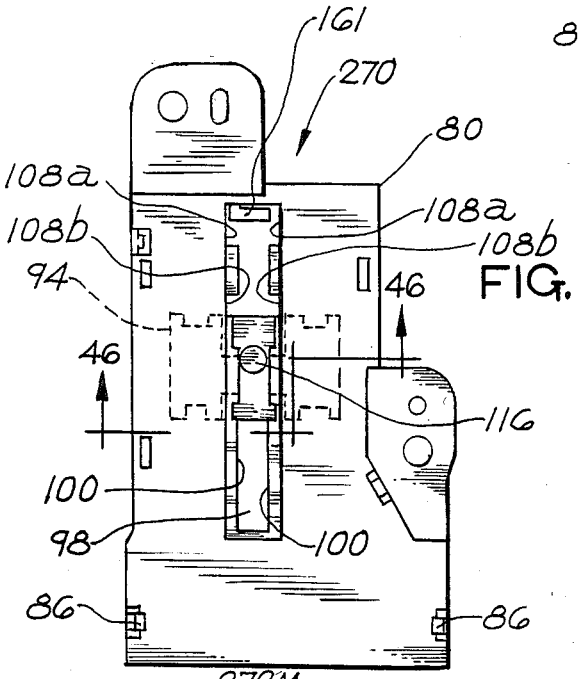
FIGS. 39, 40, 41 and 42 are front, end, rear and side views of the switch shown in FIG. 1.
Figure 41:
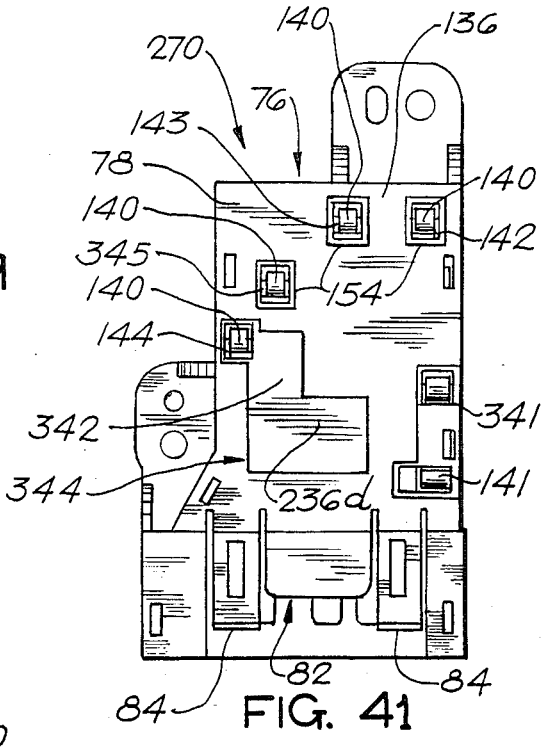

The side wall portion 88 is formed with several other latching elements in the form of ramp-like latching teeth 90, projecting inwardly from the side wall portion 88, as shown in FIG. 10. Such latching teeth 90 are adapted to snap into latching recesses 92, formed in the cover 80, as shown in FIG. 15. The latching elements 90 and 92 may be similar to those disclosed in the Raab U.S. Pat. No. 4,126,153, particularly in FIG. 5A, and the corresponding description, which are hereby incorporated herein by reference.

While latching snap fasteners are particularly advantageous, it will be understood that other known or suitable means may be employed to secure the cover 80 to the body 78 of the casing 76.

The slide switch 70 has a carriage 94 which is movable within the casing 76. At least one electrically conductive contactor 96 is mounted on the carriage 94 for movement along a predetermined path in the casing 76. The carriage 94 and the contactor 96 are shown in the assembly views of FIGS. 1, 2, 5, 6, 7 and 9. The carriage 94 is shown separately in FIGS. 19–22, while the contactor 96 is shown separately in FIGS. 23–25.

The casing 76 is provided with means for guiding the carriage 94 for sliding movement along its predetermined path in the casing. In this case, it is preferred to provide such guide means on the cover 80, in the form of a longitudinal guide slot 98 having guide flanges 100 extending along the longitudinal edges thereof. The carriage 94 has a generally rectangular portion 102 which extends through the slot 98 and is guided by the flanges 100. The carriage 94 includes two pairs of flanges **104*a* and 104*b* which overlap the flanges 100 on the cover 80, so as to retain the carriage 94 on the cover 80. The carriage 94 has side surface elements 106 which are guided by the flanges 100 on the cover 80. It will be seen from FIG. 14 that the flanges 100 are formed with two pairs of notches 108*a* and 108*b*, through which the flanges 104*a* and 104*b* may be inserted, when the carriage 94 is assembled with the cover 80. The flanges 104*a* are larger than the flanges 104*b*, and the notches 108*a* are correspondingly larger than the notches 108*b*, so that the carriage 94 is polarized and can be assembled in only the correct position in the guide slot 98**.

The carriage 94 has a flat front surface 110 which is slidable along two pairs of flat surfaces 112 and 114, extending longitudinally along the inner side of the cover 80. The flat surfaces 112 are formed on the rear sides of the flanges 100.

The carriage 94 has an operating pin or knob 116 which projects outwardly from the casing 76, for use in moving the carriage 94. The various functional positions of the knob 116 are shown in FIG. 5.

Figure 7:
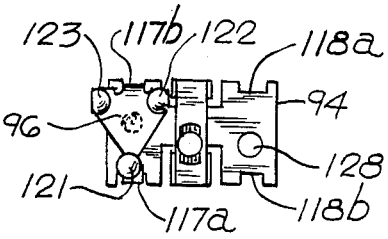
FIG. 7 is a rear view showing the carriage and the contactor, as inverted and removed from the switch of FIGS. 1–6.
Figure 9:
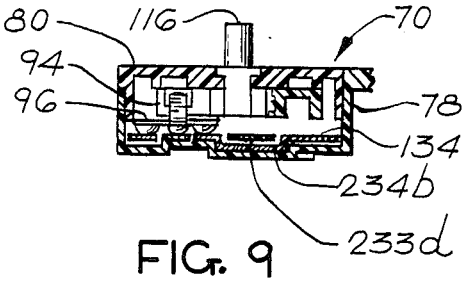
FIG. 9 is a section, taken through the switch, generally along the line 9—9 in FIG. 2.

As shown in FIGS. 7 and 9, the contactor 96 is mounted on the carriage 94 for longitudinal sliding movement with the carriage. The contactor 96 is also slidable rearwardly and forwardly, relative to the carriage 94. To provide for such rearward and forward sliding movement, the contactor 96 is preferably provided with larger and smaller guide tabs **117*a* and 117*b* which are slidably received in larger and smaller guide channels or notches 118*a* and 118*b*, formed in the carriage 94, whereby the contactor 96 is polarized and can be assembled in only the correct position on the carriage 94. In this particular switch 70, the carriage 94 is fitted with only one contactor 96, but the carriage 94 is actually adapted to receive two contactors, of the construction represented by the contactor 96. In the second embodiment of FIGS. 38–61, the carriage 94** is actually fitted with two contactors.

The contactor 96 is in the form of a plate made of copper or some other electrically conductive material. The illustrated contactor 96 is formed with three contact points 121, 122 and 123 which are shown as being spherically curved. Preferably, the contactor 96 is resiliently biased away from the carriage 94, as by means of a compression coil spring 126, shown in FIGS. 20 and 25. The spring 126 is received and located in a recess 128 formed in the carriage 94. Two such recesses 128 are formed in the carriage 94, for receiving two different springs when two different contactors are mounted on the carriage 94. Only one spring 126 and one recess 128 are utilized in the switch 70.

The spring 126 provides contact pressure between the contactor 96 and the fixed contact means of the switch 70. The details of such fixed contact means will now be described.

FIG. 6 illustrates the fixed contact means as comprising a plurality of fixed contact plates or bars 131, 132, 133 and 134, made in one piece with the respective terminal prongs 71, 72, 73 and 74. Thus, the terminal prongs 71–74 are portions of the respective contact plates 131–134, each of which is formed in one piece from sheet metal or other suitable electrically conductive material. When high electrical currents are to be carried, the contact plates are preferably made of copper. When low currents are involved, the contact plates may be made of less expensive sheet metal.

The contact plates 131–134 are supported along an insulating wall 136 which is illustrated as forming the rear wall of the casing body 78. The contact plates 131–134 are held in place along the insulating wall 136 without using any rivets or other separate fasteners.

Figure 4A:
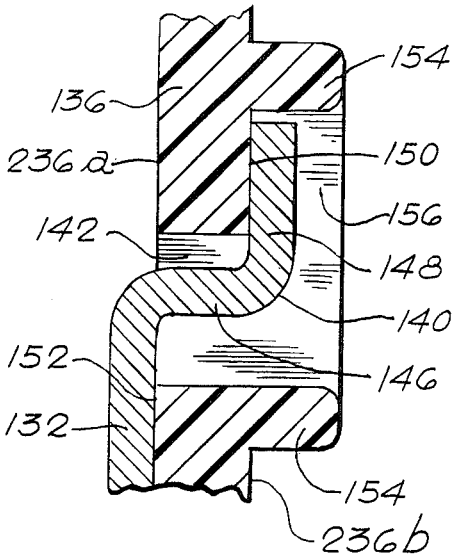
FIG. 4*a* is a fragmentary enlarged section, taken generally along the line 4*a*—4*a* in FIG. 4.

To eliminate any need for rivets, one end of each of the contact plates 131–134 is provided with an end portion formed as an L-shaped hook or tongue 140, as shown most clearly in FIG. **4*a*, adapted to be inserted through a slot in the supporting wall 136, so as to hook behind the supporting wall 136. FIG. 4*a* illustrates the L-shaped hook 140 on the second contact plate 132**.

Figure 12:
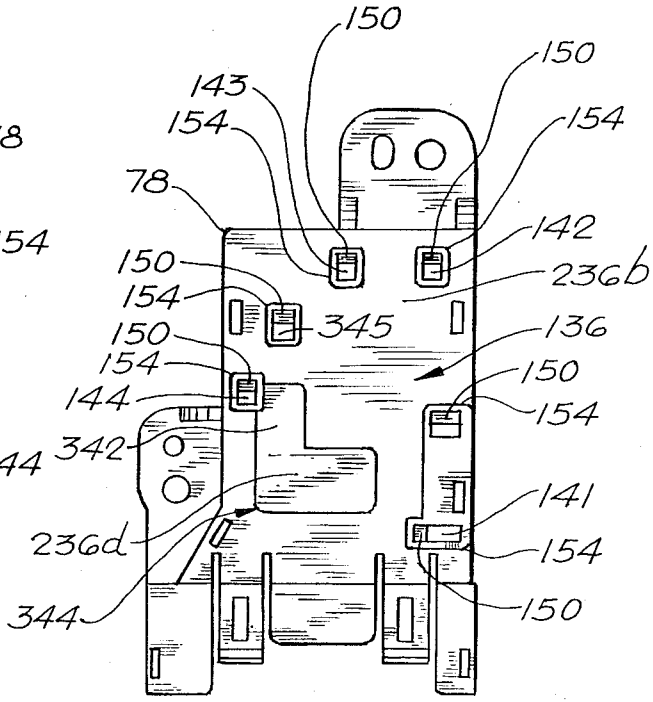
FIGS. 11, 12 and 13 are side, rear and end views of the body of the casing for the switch of FIGS. 1–10.
Figure 11:
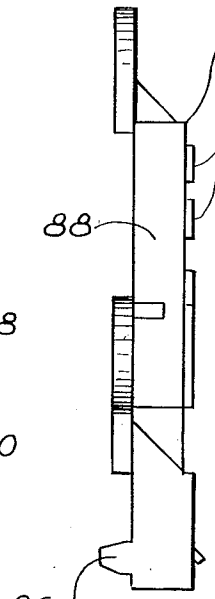

The L-shaped hooks on the four contact plates 131–134 are adapted to be inserted through four slots 141, 142, 143 and 144, formed in the supporting wall 136, such slots being shown most clearly in FIGS. 10 and 12, which illustrate the casing body 78 separately. The second slot 142 is illustrated in the enlarged section of FIG. **4*a*. The third and fourth slots 143 and 144 are substantially the same as the slot 142. The first slot 141 is the same in principle as the slot 142**, but differs slightly in shape and orientation.

The second, third and fourth contact plates 132, 133 and 134 have L-shaped hooks 140 which are substantially the same in construction. As shown most clearly in FIG. **4*a*, the L-shaped hook 140 comprises a flange portion 146 which is bent rearwardly from the contact plate 132, and a second flange or prong portion 148 which is bent endwise from the first flange 146 and is adapted to hook behind a rear or outer surface portion 150 of the supporting wall 136. The contact plate 132 extends along a front or inner surface 152 of the supporting wall 136. The first flange portion 146 of the L-shaped hook 140 is adapted to extend through the slot 142. As shown in FIG. 4*a*, the slot 142 is sufficiently large to make it easy to insert the L-shaped hook 140, by swinging and translating the contact plate 132**.

The supporting wall 136 is preferably formed with an enclosure flange 154 which extends around the slot 142 and the adjacent outer surface portion 150 of the wall 136. The enclosure flange 154 projects outwardly or rearwardly from the supporting wall 136 and effectively provides a recess 156 for the L-shaped hook 140. The enclosure flange 154 affords electrical insulation for the L-shaped hook 140, particularly the second flange portion 148 thereof, so as to keep the hook 140 from coming into contact with electrically conductive materials.

In FIG. 12, the outer surface elements 150 and the enclosure flanges 154 have been given the same reference characters as to all four of the slots 141–144, because these elements are substantially the same in all four cases, differing only slightly as to size and shape.

As shown in FIGS. 29–37, the L-shaped hooks on the second, third and fourth contact plates 132, 133 and 134 are all substantially the same in construction. As shown in FIGS. 26–28, the L-shaped hook 140 on the first terminal plate 131 has the first and second flanges, as before, but the second flange is provided with a laterally projecting tongue or tang 158, as shown most clearly in FIGS. 27 and 28. The tang 158 hooks behind the outer surface element 150, adjacent the first slot 141, as shown most clearly in FIG. 4.

As shown most clearly in FIG. 4*a*, the second flange or prong 148 of the L-shaped hook 140 is in a plane which is substantially parallel with the plane of the contact plate 132, but is offset or spaced rearwardly therefrom. This is true as to all of the contact plates 131–134.

In assembling the switch 70, the L-shaped hooks or tongues 140 on the contact plates 131, 132, 134 and 133 are inserted into the respective slots 141, 142, 144 and 143; and the contact plates are then laid in the body 78 of the casing 76, as shown most clearly in FIG. 6. The terminal portions of the contact plates 131–134 are then accurately located in the casing body 78 by locating means 160, to be described presently. The carriage 94 is assembled with the cover 80 of the casing 76; and the contactor 96 is mounted on the carriage 94, with the spring 126 therebetween.

The assembly of the switch is completed by mounting the cover 80 on the body 78 of the casing 76. This is done by aligning the cover with the body 78 and pressing the cover and the body together, so that the latching fastener elements 90 on the body 78 snap into latching engagement with the latching recesses 92 on the cover 80. At the same time, the latching projections 86 snap into latching engagement with the front of the cover 80, as shown in FIGS. 1 and 3.

To assemble the carriage 94 with the cover 80, the larger and smaller flanges **104*a* and 104*b* of the carriage are inserted through the larger and smaller notches in the flanges 100 on the cover 80. The carriage 94 is then slid along the slot 98 in the cover, with the flanges 104*a* and 104*b* slidably engaging the front sides of the flanges 100 on the cover 80**.

The body 78 of the casing 76 is formed with an L-shaped stop 161 which limits the upward sliding movement of the carriage 94, as shown in FIG. 2, after the cover 80 has been mounted on the body 78, so that the flanges **104*a* and 104*b* can not be moved into alignment with the notches 108*a* and 108*b*, whereby the rectangular portion of the carriage 102 is retained in the slot 98, so that the carriage 94 can not drop back into the interior of the casing 76**.

The terminal portions of the contact plates 131–134 are retained in the casing body 78 by retaining means 162 on the cover 80, as shown in FIG. 3. The details of such retaining means are to be described presently.

Figure 13:
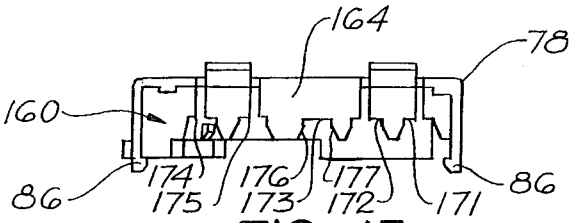

FIGS. 3, 6 and 13 illustrate the locating means 160 as comprising end wall means 164 on the casing body 78, molded in one piece therewith. Nests or notches 171, 172, 173 and 174 are formed in the end wall means 164 for receiving and locating the respective terminal prongs 71, 72, 73 and 74. There is also a fifth nest or notch 175 which is not used for the switch 70 but rather is left vacant. The notch 175 is used for the second embodiment, illustrated in FIGS. 38–61.

The nests or notches 171–174 are preferably shaped and dimensioned to receive the respective terminal prongs 71–74 with a snug fit, and preferably with a slight detent action, tending to retain the terminal prongs in the notches. Such detent action is provided by a pair of oppositely directed detent bumps or projections 176 and 177, formed on the sides of each of the notches 171–175. The detent bumps 176 and 177 have the advantage of tending to retain the terminal prongs 71–74 temporarily, while the switch is being assembled.

Figure 16:
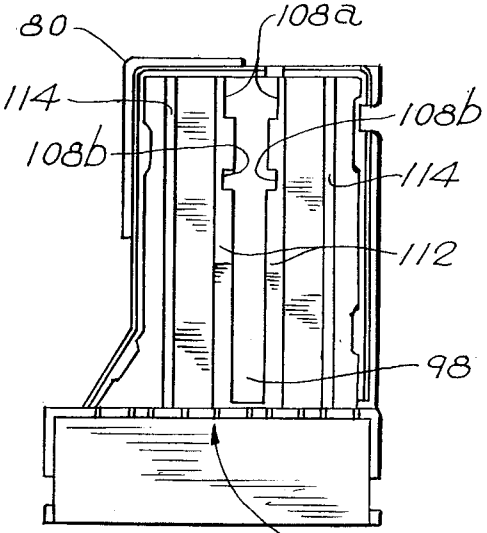
Figure 18:
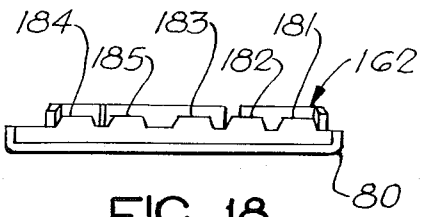

FIGS. 3 and 16 illustrate the retaining means 162 as comprising a plurality of tooth-like projections 181, 182, 183 and 184, molded in one piece with the cover 80 of the casing 76. Such projections are adapted to engage the respective terminal prongs 71, 72, 73 and 74, so as to retain them snugly in the nests or notches 171, 172, 173 and 174. There is also a fifth projection 185 which is opposite the vacant nest or notch 175, in the case of the switch 70 of FIGS. 1–37.

By means of the locating notches or nests 171–174, the terminal prongs 71–74 are located in their correct positions against lateral edgewise movement. The terminal prongs 71–74 are retained in the locating notches 171–174 by the tooth-like projections 181–184, against transverse or flatwise lateral movement.

The terminal prongs 71, 72, 73 and 74 are also located in their correct positions against longitudinal movement. This is accomplished by additional locating elements on the terminal prongs 71–74 and on the associated terminal portions of the contact plates 131–134.

As shown in FIGS. 26–37, the respective contact plates 131, 132, 133 and 134 comprise respective terminal portions 191, 192, 193 and 194 which include not only the terminal prongs 71, 72, 73 and 74, but also respective terminal flanges 201, 202, 203 and 204, bent at right angles between the respective terminal prongs 71–74 and the respective contact plates 131–134. Thus, the terminal flanges 201–204 are bent forwardly at right angles from the respective contact plates 131–134, while the terminal prongs 71–74 are bent outwardly at right angles from the respective flanges 201–204. Accordingly, the terminal portions 191–194 are L-shaped.

As shown in FIG. 10, the end wall means or formation 164 on the casing body 78 has inner and outer sides 206 and 208, which are involved in the locating means 160, in that the terminal flanges 201–204 of the contact plates 131–134 are engageable with the inner side 206 of the end wall 164, to establish the correct longitudinal positions of the contact plates 131–134. To engage or overlap with the outer side 208 of the end wall 164, each of the terminal prongs 71–74 is provided with locating elements which may be formed as projections or tabs 210, extending laterally or edgewise from the terminal prongs 71–74, and spaced longitudinally along the terminal prongs from the corresponding terminal flanges 201–204. As shown in FIGS. 26–37, each of the terminal prongs 71–74 is provided with a pair of the locating tabs 210. The locating tabs 210 are also clearly shown in FIG. 6. It will be seen that the terminal flanges 201–204 and the tabs 210 overlap the inner and outer sides of the end wall 164, so that the corresponding contact plates 131–134 are precisely and securely located against longitudinal or endwise movement.

As shown most clearly in FIG. 6, the contactor 96 is engageable with various contact portions of the contact plates 131–134, in the various functional positions of the contactor. Other portions of the contact plates 131–134 are employed to connect the contact portions to the terminal prongs 71–74, and to afford mechanical support for the contact plates.

In FIG. 6, the contactor 96 is shown in broken lines, in its extreme positions of movement. In the lowermost position of the contactor 96, as shown in FIG. 6, the contactor is in its OFF position. In the uppermost position, the contactor 96 is in its DEF(defrost) position. The three contact points 121, 122 and 123 of the contactor 96 are engageable with various contact portions of the contact plates 131–134.

In the lowermost or OFF position of the contactor 96, the contact point 123 engages the contact plate 131, serving as a fixed contact member to energize the SHUT OFF DOOR circuit. The contact plate 131 is not engaged by the contactor 96 in any other functional position of the contactor 96.

In all of the other functional positions of the contactor 96, other than the OFF position, the contact point 123 engages a contact portion **232*a* of the contact plate 132, so as to energize the motor circuit. The contact plate 232 has another contact portion 232*b* which projects laterally, so as to be engaged by the contact point 122, as it moves between the OFF position and the VENT position of the contactor 96. This engagement provides a second switching action, to energize and de-energize the motor circuit, simultaneously with the switching action provided by the engagement between the contact point 123 and the contact portion 232*a*. The provision of the second simultaneous switching action prolongs the life of the switch 70 by distributing the arcing which occurs between the contactor and the two contact portions 232*a* and 232*b***.

The contact plate 132 has another contact portion **232*c* which is engaged by the contact point 121 in the MIX, HEAT and DEF positions of the contactor 96. This engagement provides a second point of engagement between the contactor 96 and the contact plate 132, and also serves to maintain all three contact points 121, 122 and 123 at the same level, for smoother switch operation. Moreover, the L-shaped hook 140 is formed on the portion 232*c*, for insertion through the slot 142**.

The third contact plate 133 has a contact portion **233*a* which is engaged by the contact point 121 in the OFF, VENT and MIX positions of the contactor 96, so that the contactor is supplied with current from the battery circuit. In the OFF position, the contact point 122 also engages a contact portion 233*b* of the contact plate 133, so that all three contact points 121, 122 and 123 are maintained at the same level, to avoid uneven rocking of the contactor 96**.

The contact plate 133 has another contact portion **233*c* which is engaged by the contact point 122 in the MIX, HEAT and DEF positions of the contactor 96, so as to establish a connection between the battery circuit and the contactor 96. The contact plate 133 has another portion 233*d* which is not engaged by the contactor 96 but is needed to form an electrical connection between the terminal prong 93 and the contact portions 233*a* and 233*c*. As will be described in detail presently, the portion 233*d* is involved in a crossover with the contact plate 134**.

The contact plate 133 also has a portion **233*e*, on which the L-shaped hook 140 is formed, for insertion through the slot 143**.

The fourth contact plate 134 has only one small contact portion **234*a* which is engaged by the contact point 122 in the VENT position of the contactor 96, to energize the auxiliary door circuit. It will be seen from FIG. 6 that the contact portion 234*a* is surrounded by the contact portions 232*b*, 233*a* and 233*c*, as well as the connecting portion 233*d*. In order to establish an electrical connection between the contact portion 234*a* and the terminal prong 74, the contact plate 134 is provided with a crossover portion 234*b*, which is overlapped by the connecting portion 233*d*, but without any electrical contact therebetween. The crossover portion 234*b* is connected to a large supporting portion 234*c* of the plate 134. The terminal prong 74 and the L-shaped hook 140 are bent from opposite ends of the portion 234*c*, such hook being inserted through the slot 144**.

As shown most clearly in FIGS. 6–9 and 35–37, the crossover portion **234*b* is U-shaped and is bent from the contact plate 134, which is formed in one piece. The contact portion 234*a* and the main supporting portion 234*c* of the contact plate 134 are in the same plane, which is also the plane of the overlapping portion 230*d* of the adjacent contact plate 133. However, the U-shaped crossover portion 234*b* has a flat submarining crossover member 234*d* which is offset into a different plane, substantially parallel with the plane of the portions 233*d*, 234*a* and 234*c*, but spaced therefrom, so that the submarining portion 234*d* is spaced away from the overlapping portion 233*d* and is out of electrical contact therewith. In this way, a crossover is achieved in a highly advantageous manner. The U-shaped crossover portion 234*b*** can be formed very easily, and is highly compact.

As previously indicated, the body 78 of the casing 76 has a main or rear supporting wall 136 which supports the contact plates 131–134. As shown in FIGS. 10 and 12, the supporting wall 136 has a flat front or inner surface **236*a* and also a rear or outer surface 236*b*. The contact plates 131, 132 and 133 engage the inner surface 236*a*, which is also engaged by the contact portion 234*a* and the supporting portion 234*c* of the contact plate 134. The U-shaped crossover portion 234*b* is received in a shallow recess 236*c*, formed in the inner surface 236*a* of the wall 136. The formation of the recess 236*c* results in the formation of a protuberance or boss 236*d*, projecting slightly from the rear surface 236*b* of the wall 136. The slight projection of the boss 236*d* is approximately the same as the projection of the enclosure flanges 154. Thus, the thickness of the switch casing 76 is not increased appreciably by the provision of the boss 236*d***.

FIGS. 38–61 illustrate a modified slide action electrical switch 270, to be described as a second illustrative embodiment of the present invention. The two switches 70 and 270 have a great deal in common, in that both switches employ exactly the same casing 76 and the same carriage 94. The second switch 270 is more elaborate, in that it employs two contactors, rather than one. Moreover, the switch 270 has five terminal prongs and five contact plates, rather than four. Such contact plates are more elaborately arranged, in that they provide two crossovers, rather than one. The individual crossovers are similar to the crossover provided by the U-shaped submarining crossover portion **234*b* and the overlapping portion 233*d* in the first switch 70**.

The switch 270 of FIGS. 38–61 is especially well adapted for controlling a heating, ventilating and air conditioning system for an automobile or some other automotive vehicle. The switch 270 employs the same casing 76, including both the body 78 and the cover 80, as previously described. The switch 270 also employs the carriage 94, the contactor 96 and the spring 126, as previously described. The illustration of these components in FIGS. 10–25 is fully applicable to the switch 270, and the same reference characters are applicable.

Figure 40:
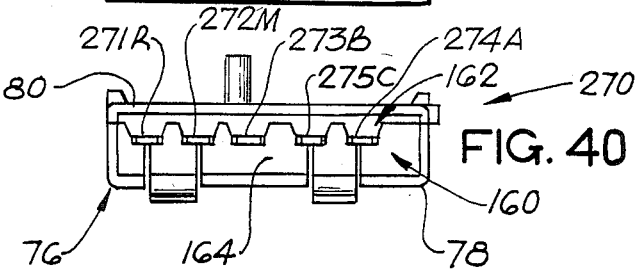
Figure 43:
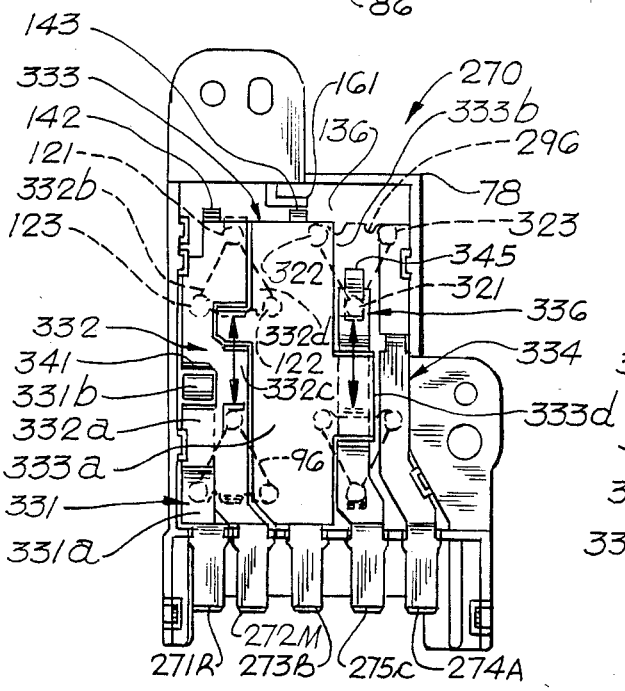
FIG. 43 is a front view, similar to FIG. 39, but with the cover and the carriage removed from the switch, the extreme positions of the movable contactors being shown in broken lines.

As shown in FIGS. 40 and 43, the switch 270 is provided with five terminal prongs; 271R, where R indicates that the prong is adapted to be connected to the recirculation door circuit; 272M, where M indicates that the prong is adapted to be connected to the motor circuit; 273B, where B indicates that the prong is adapted to be connected to the battery circuit; 274A, where A indicates that the prong is adapted to be connected to the auxiliary door circuit; and 275C, where C indicates that the prong is adapted to be connected to the clutch circuit for the air conditioning compressor.

To coordinate with the illustration of the casing body 78 in FIG. 13, the terminal prongs 271R, 272M, 273B, 274A and 275C are arranged in such an order that they are adapted to occupy the respective nests or notches 171, 172, 173, 174 and 175. In particular, it should be noted that the terminal prong 275C occupies the nest 175, which is vacant in the case of the first switch 70.

Figure 44:
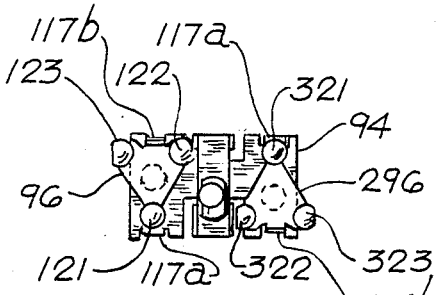
FIG. 44 is a rear inverted view, showing the carriage and the contactors, as removed from the switch of FIGS. 38–43.
Figure 46:
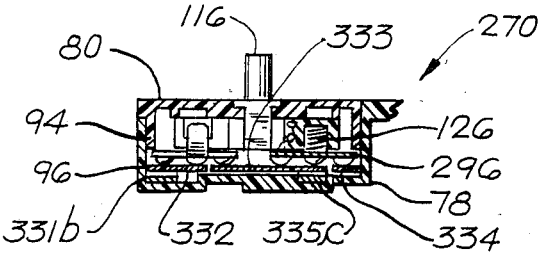
FIG. 46 is a section, taken generally along the broken line 46—46 in FIG. 39.

As shown in FIG. 44, the carriage 94 of the second switch 270 is fitted with a second contactor 296, in addition to the first contactor 96. The second contactor has three contact points 321, 322 and 323, and is substantially the same in construction as the contactor 96. The two contactors 96 and 296 are oppositely oriented, as shown in FIG. 44. A second coil spring 126 is provided between the carriage 94 and the second contactor 296, for resiliently biasing the second contactor into engagement with the fixed contact plates, to be described presently.

Figure 42:
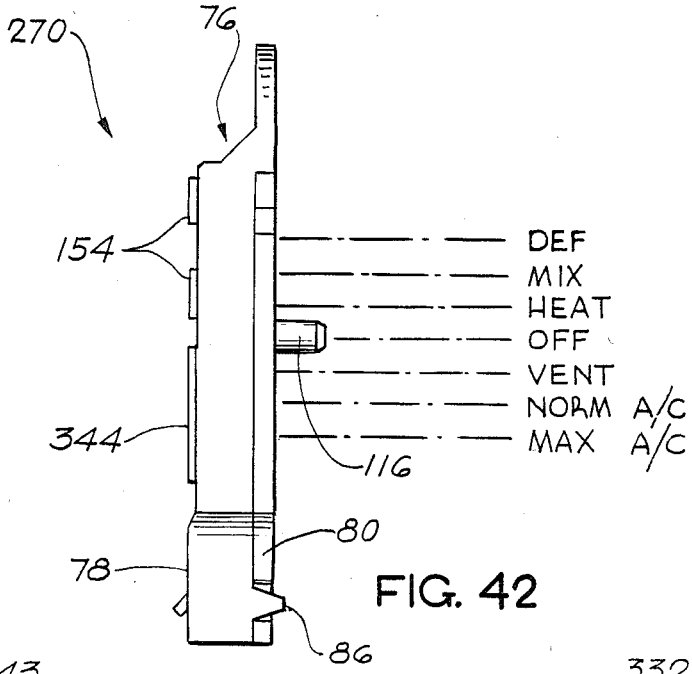

As shown in FIG. 42, the switch 270 has seven operating or functional positions, into which the carriage 94 and its operating knob 116 are movable. Such positions are labelled in FIG. 42 as follows: DEF(defrost), MIX, HEAT, OFF, VENT, NORM A/C (normal air conditioning), MAX A/C (maximum air conditioning).

In the DEF position, the switch 270 connects the battery terminal 273B to the motor terminal 272M and the clutch terminal 275C. In the MIX position, the same connections are established by the switch 270. In the HEAT position, the battery terminal 273B is connected to the motor terminal 272M. In the OFF position, the switch 270 connects the battery terminal 273B to the refrigeration door terminal 271R. In the VENT position, the battery terminal 273B is connected to the motor terminal 272M and the auxiliary door terminal 274A. In the NORM A/C (normal air conditioning) position, the battery terminal 273B is connected to the motor terminal 272M, the auxiliary door terminal 274A, and the clutch terminal 275C. In the MAX A/C (maximum air conditioning) position, the switch 270 connects the battery terminal 273B to the motor terminal 272M, the auxiliary door terminal 274A, the clutch terminal 275C and the refrigeration door terminal 271R.

As shown in FIG. 43, the switch 270 is fitted with five fixed contact plates 331, 332, 333, 334 and 335, for selective engagements by the contactors 96 and 296.

As shown in FIGS. 47–61, one end of each of the fixed contact plates 331–335 is formed with one of the L-shaped hooks 140, as previously described in connection with the switch 70. The L-shaped hooks 140 are bent from the contact plates 331–335. As before, the L-shaped hooks 140 are inserted through slots formed in the rear or main supporting wall 136 of the casing body 78 and are hooked behind outer surface elements 150 on the wall 136. The L-shaped hooks 140 on the contact plates 332, 333 and 334 are inserted through the slots 142, 143 and 144 in the rear wall 136, as previously described in connection with the first switch 70. The L-shaped hooks 140 on the contact plates 331 and 335 are inserted through additional slots 341 and 345 in the supporting wall 136, as shown in FIGS. 10 and 43. The engagement of the L-shaped hooks 140 with the supporting wall 136 is the same in these cases as previously described. The terminals 271R, 272M, 273B, 274A and 275C may be located and retained between the body 78 and the cover 80 of the casing 76, the same as described in connection with the terminals 71–74 of the first switch 70.

The contact plates 331–335 of the second switch 270 have contact portions which are engageable by the contactors 96 and 296, as will be described in greater detail presently. The contact plates 331–335 also have other portions which afford mechanical support and which conduct electrical currents between the contact portions and the terminals 271R–275C, respectively.

In FIG. 43, the contactors 96 and 296 are shown in broken lines at the opposite ends of their operative paths of movement. As the contactors 96 and 296 are moved alongs their paths to their various functional positions, the contact points on the contactors engage the various contact portions of the contact plates 331–335.

The contact plate 331 has two longitudinally spaced contact portions **331*a* and 331*b* which are engaged by the contact point 123 at the MAX A/C and OFF positions of the switch 270. The contact plate 331 has a U-shaped crossover portion 331*c* which extends between the contact portions 331*a* and 331*b*. The crossover portion 331*c* is substantially the same in construction as the crossover portion 234*b*, described in connection with the first switch 70. As before, the U-shaped crossover portion 331*c* has a flat submarining member 331*d* which is offset into a plane spaced rearwardly from but substantially parallel to the plane of the contact portions 331*a* and 331*b*. It will be understood that the contact portions 331*a* and 331*b* afford connections between the contactor 96 and the refrigeration door circuit, which is connected to the terminal 271R**.

The contact plate 332 has contact portions **332*a* and 332*b* which are engaged by the contact point 123 at different positions of the switch 270. Thus, the contact point 123 engages the contact portion 332*a* in the NORM A/C position and the VENT position of the switch 270. The contact point 123 engages the contact portion 332*b* in the HEAT, MIX and DEF positions of the switch 270. These contact portions 332*a* and 332*b* serve to connect the contactor 96 to the motor circuit, to which the terminal 272M** is connected.

Figure 45:
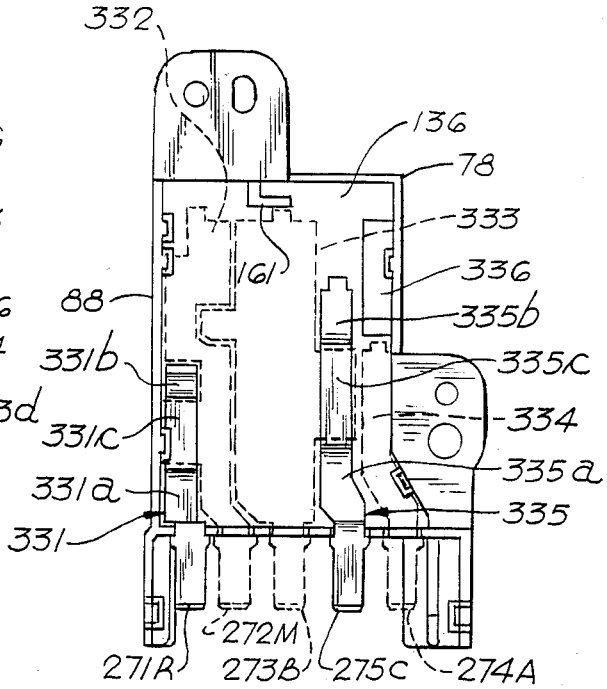
FIG. 45 is a front view, similar to FIG. 43, but with three of the five contact plates removed, the removed contact plates being shown in broken lines, while the remaining contact plates, having submarining crossover portions, are shown in full lines.

It will be seen from FIGS. 43 and 45 that the contact portion **332*a* of the contact plate 332 overlaps the submarining crossover member 331*d*, but is spaced forwardly therefrom, so that there is no electrical contact therebetween. The crossover between the U-shaped crossover portion 331*c* and the contact portion 332*a* is substantially the same as described previously, in connection with the U-shaped crossover portion 234*b* and the overlapping portion 233*d***.

The contact plate 332 has additional contact portions **332*c* and 332*d* which are engageable by the contact point 121 of the contactor 96, to afford engagement between the contactor 96 and the motor circuit in various positions of the switch 270. Thus, the contact point 121 engages the contact portion 332*c* in the MAX A/C, NORM A/C and VENT positions of the switch 270**.

The contact point 121 engages the contact portion 332*d* in the HEAT, MIX and DEF positions of the switch 270. In certain positions of the switch 270, the contact points 121 and 123 provide duplicate connections between the contactor 96 and the motor circuit, so as to prolong the life of the switch.

It will be seen from FIGS. 43 and 50 that the contact plate 332 is formed with notches or cutouts 332*e* and 332*f*. The notch 332*e* is formed between the contact portions 332*a* and 332*b* and is adapted to receive the contact portion 331*b* of the contact plate 331, but without any electrical contact between the plates 331 and 332.

The notch 332*f* provides an OFF position, in which the contact point 121 of the contactor 96 is out of engagement with the contact plate 332, so that the motor circuit is not energized. In the OFF position, the contact point 121 engages a tab portion of the contact plate 333, as will be described in greater detail presently.

The contact plate 333 has a contact portion 333*a* which is engaged by the contact point 122 in all of the positions of the switch 270, so that the contactor 96 is connected to the battery circuit in all such positions.

The contact plate 333 also has a contact portion 333*b* which is engaged by the contact point 322 in all positions of the switch 270, so that the contactor 296 is connected to the battery circuit in all of the switch positions.

It will be seen from FIGS. 43 and 53 that the contact plate 333 has a contact portion 333*c* in the form of a tab projecting from the contact portion 333*a*. The tab 333*c* is adapted to be received in the notch or cutout 332*f*, formed in the contact plate 332, but in spaced relation thereto, so that there is no electrical contact between the tab 333*c* and the contact plate 332. The tab 333*c* is engaged by the contact point 121 in the OFF position of the switch, when such contact point is out of engagement with the contact plate 332, so that the contactor is not connected to the motor circuit. The provision of the tab 333*c* affords a stable support for the contact point 121 and provides for smooth movement of such contact point across the notch or cutout 332*f*, without any excessive rocking of the contactor 96. The engagement between the contact point 121 and the tab 333*c* provides an extra connection between the contactor 96 and the battery circuit, supplementing the connection afforded by the engagement of the contact point 122 with the longitudinal portion 333*a* of the contact plate 333.

The contact plate 333 has another contact portion 333*d* which is in the form of a somewhat larger tab, projecting laterally from the longitudinal contact portion 333*b*. The tab 333*d* is engaged by the contact point 321 in the HEAT, OFF and VENT positions of the switch, when it is desired to de-energize the clutch circuit. For these positions of the switch, the engagement between the contact point 321 and the tab 333*d* affords an extra connection between the battery circuit and the contactor 296, supplementing the connection afforded by the engagement of the contact point 322 with the longitudinal contact portion 333*b*. The tab 333*d* overlaps a crossover portion of the contact plate 335, as will be described in greater detail presently.

It will be seen from FIGS. 43 and 60 that the contact plate 334 has a contact portion 334*a* which is engaged by the contact point 323, so as to energize the auxiliary door circuit in the MAX A/C, NORM A/C and VENT positions of the switch 270. In the other positions of the switch, the contact point 323 slides along an insulating boss 336, projecting inwardly on the supporting wall 136 so as to be substantially level with the contact portion 334*a*. The boss 336 supports the contact point 323 and maintains the contactor 296 on an even keel, so as to minimize rocking of the contactor. In this way, the smooth movement of the contactor is promoted.

As shown in FIGS. 43, 45, 56 and 57, the contact plate 335 has contact portions 335*a* and 335*b*, with a U-shaped crossover portion 335*c* connected therebetween and formed in one piece with the contact plate 335. The contact portion 335*a* is engaged by the contact point 321 in the MAX A/C and NORM A/C positions of the switch 270, so as to energize the air conditioning clutch circuit. The contact point 321 engages the second contact portion 335*b* so as to energize the air conditioning clutch circuit in the MIX and DEF positions of the switch. The clutch circuit is not energized in the OFF and HEAT positions of the switch. For these positions, the contact point 321 engages the tab 333*d* on the battery circuit contact plate 333, thus providing an extra or redundant connection with the battery circuit, while preventing the contact point 321 from engaging the crossover portion 335*c*.

It will be seen that the construction of the U-shaped crossover portion 335*c* is substantially the same as the construction of the previously described crossover portion 234*b*. Thus, the contact portions 335*a* and 335*b* are in one plane, corresponding to the plane of all of the other contact portions. The U-shaped crossover portion 335*c* has a flat crossover member 335*d* which is offset rearwardly into a parallel plane, spaced rearwardly from the plane of the contact portions 335*a* and 335*b*.

As shown in FIG. 43, the crossover portion 335*c* is overlapped by the tab-shaped contact portion 333*d* of the battery contact plate 333. The overlapping portion 333*d* is in the plane which is shared by the contact portions 335*a* and 335*b*. Thus, the overlapping portion 333*d* is spaced forwardly from the flat crossover member 325*d* and is not in electrical contact therewith.

The U-shaped crossover portion 335*c* is received in a shallow recess 338, formed in the inner or front surface 236*a* of the supporting wall 136, as shown most clearly in FIG. 10. The recess 338 connects with the recess 236*c*, so that the combined recesses form a single large L-shaped recess 340. The formation of the recess 338 results in the formation of a low protuberance or boss 342, projecting slightly from the outer surface 236*b* of the supporting wall 136. As shown in FIG. 12, the boss 342 connects with the previously mentioned boss 236*d*, to form a combined L-shaped boss 344.

As previously indicated, the terminals 271R, 272M, 273B, 274A and 275C, and the corresponding contact plates 331–335, are located and retained in the casing body 78, in the same manner previously described in the case of the first switch 70, with reference to the terminals 71–74 and the corresponding contact plates 131–134. Thus, the terminals 271R, 272M, 273B, 274A and 275C are received and located in the nests or notches 171–175, formed in the end wall 164 of the casing body 78, and are retained in such notches by the projections or teeth 181–185 on the casing cover 80.

As before, the terminals 271R, 272M, 273B, 274A and 275C are provided with the laterally projecting tabs 210 which overlap the outer side of the end wall 164 on the casing body 78, as shown in FIG. 43.

As before, the terminal prongs 271R, 272M, 273B, 274A and 275C are components of L-shaped terminal portions or members 391, 392, 393, 394 and 395, bent from the contact plates 331–335 and formed in one piece therewith. The L-shaped terminal portions 391–395 also include respective terminal flanges 401, 402, 403, 404 and 405, bent transversely from the respective contact plates 331–335, so that the terminal prongs 271R–275C are offset from the respective contact plates 331–335, but in planes parallel with the planes of the plates 331–335. The transversely extending terminal flanges 401–405 engage and overlap the inner side of the end wall 164 on the casing body 78, as in the case of the terminal flanges 201–204 in the first switch 70 of FIGS. 1–37.

The first switch 70 employs one crossover portion **234*b*, as illustrated in FIGS. 6, 8, 36 and 37, while the second switch 270 employs two crossover portions 331*c* and 335*c*, in similar but specifically different arrangements, as illustrated in FIGS. 43, 45, 47, 48, 56 and 57**. These examples will serve to illustrate that such crossover portions may be employed very advantageously in a variety of situations and arrangements, to effectuate a crossover between portions of two contact plates, without any electrical contact therebetween. The crossovers have the advantages of being inexpensive, uncomplicated and highly compact.

The construction of both switches 70 and 270 makes it easy to assemble the contact plates into the casing of the switch, without using any rivets or other separate fasteners, and without any need to employ any tools or apparatus. Each contact plate is installed by inserting its L-shaped hook or tongue through the corresponding slot in the body of the casing. The terminal prong is then seated in the corresponding nest or notch in the end wall of the body. The inner and outer sides of the end wall are overlapped by the terminal flange and the locating tabs, so that the contact plate is accurately positioned and secured against endwise movement. After all of the plates have been installed in the body of the casing, the cover is simply pressed into place on the body, until the latching fastener elements snap together. The prongs are retained in their nests by the teeth on the cover. The cover assembly includes the cover itself, the carriage, the contactor spring or springs, and the contactor or contactors. The components of the cover assembly are assembled separately, before pressing the cover into place on the body of the casing.

The elimination of the rivets and the simplicity of the assembly procedure bring about a substantial reduction in the cost of the switch, while maintaining a high standard of quality.

We claim:

1. An electrical switch, comprising an insulating casing, a plurality of fixed contact plates mounted in said casing and having a plurality of fixed contact portions, an insulating carriage mounted in said casing, said casing having means for guiding said carriage for movement along a predetermined path, at least one electrically conductive contactor mounted on said carriage for movement therewith along said path and for selective engagement with certain of said contact portions, said plates including at least a first plate having a U-shaped formation bent therefrom and extending between different portions of said first plate, said U-shaped formation including a substantially flat submarining crossover portion which is offset into a plane which is different from but substantially parallel with the plane of said different portions of said first contact plate, said plates including at least a second plate having an overlapping portion which overlaps with and is crossed by said submarining crossover portion but is in a different plane from the plane of said submarining crossover portion and is spaced therefrom while being substantially parallel therewith to obviate any electrical contact between said submarining crossover portion and said overlapping portion.

2. An electrical switch according to claim 1, in which said overlapping portion is also one of said contact portions.

3. An electrical switch according to claim 1, in which said U-shaped formation is one of a plurality of such formations having corresponding submarining crossover portions, said overlapping portion being one of a plurality of such overlapping portions which overlap the corresponding submarining crossover portions.

4. An electrical switch according to claim 3, in which said overlapping portions are also contact portions.

5. An electrical switch according to claim 1, in which said casing includes means forming a recess for receiving said submarining crossover portion.

6. An electrical switch according to claim 1, in which said casing includes an insulating wall for supporting said fixed contact plates, said wall having a recess therein for receiving said submarining crossover portion.

7. An electrical switch according to claim 1, in which said fixed contact plates include respective terminal prongs, each of said terminal prongs being formed in one piece with the corresponding contact plate.

8. An electrical switch according to claim 1, said first plate having one of said contact portions, said submarining crossover portion extending between said contact portion of said first plate and another portion thereof, said second plate having a plurality of said contact portions, said overlapping portion extending between different contact portions of said second plate.

9. An electrical switch according to claim 1, said first contact plate having a first contact portion constituting one of said fixed contact portions, said second contact plate having a plurality of said contact portions including second and third contact portions of said second contact plate, said contact plates having respective terminal prongs thereon, each of said terminal prongs being formed in one piece with each of the respective contact plates, said submarining crossover portion of said first plate extending between said first contact portion and another portion of said first contact plate affording a connection to the corresponding terminal prong, said overlapping portion of said second plate affording a connection between said second and third contact portions of said second plate and also affording a connection to the terminal prong of said second plate.

10. An electrical switch according to claim 9, in which said contactor has a contact point which is movable into engagement with said first, second and third contact portions at different positions of said contactor along its path of movement.

11. An electrical switch according to claim 1,
in which said first plate comprises a plurality of said contact portions including first and second contact portions,
said submarining crossover portions extending between said first and second contact portions,
said overlapping portion of said second plate also constituting a third contact portion comprising one of said originally mentioned contact portions.

12. An electrical switch according to claim 11,
in which said contactor comprises a contact point which is engageable with said first, second and third contact portions at different positions of said contactor along its path of movement.

13. An electrical switch according to claim 12,
in which said contact plates comprise respective terminal prongs connected to and formed in one piece with said respective contact plates,
said submarining crossover portion affording a connection between one of said contact portions and another portion of said first plate to which the corresponding terminal prong is connected.

14. An electrical switch according to claim 11,
in which said respective contact plates comprise terminal prongs connected to and formed in one piece with the respective contact plates,
the terminal prong of said first contact plate being connected to said second contact portion thereof,
said submarining crossover portion of said first contact plate affording a connection to the terminal prong by way of said second contact portion of said first contact plate.

15. An electrical switch, comprising
an insulating casing having a body with a supporting wall,
said casing also having a cover,
a plurality of fixed contact plates mounted in said casing along said supporting wall,
said contact plates having a plurality of fixed contact portions,
an insulating carriage mounted in said casing,
said casing having means for guiding said carriage for movement along a predetermined path,
and at least one electrically conductive contactor mounted on said carriage for movement therewith along said path and for selective engagement with certain of said contact portions,
said supporting wall of said casing having a plurality of slots therein,
said plates having respective first end portions formed as generally L-shaped hooks for reception in said respective slots to retain said first end portions against said supporting wall,
said plates having respective second end portions formed as respective electrical terminals,
said body of said casing having nest means forming respective nests for receiving said respective terminals,
said cover and said body having fastener means for fastening said cover to said body,
said cover having retainer elements for engaging and retaining said terminals in said nests.

16. An electrical switch according to claim 15,
said supporting wall having inner and outer sides,
said contact plates being mounted along the inner side of said supporting wall,
each of said L-shaped hooks comprising first and second flange portions,
said first flange portion being bent from the corresponding contact plate and extending through the corresponding slot,
said second flange portion being bent from said first flange portion and extending behind the outer side of said supporting wall.

17. An electrical switch according to claim 16,
said supporting wall having a plurality of enclosure flanges projecting from the outer side of said supporting wall and extending around said slots and adjacent portions of said outer side to afford electrical insulation for the second flange portions of said L-shaped hooks.

18. An electrical switch according to claim 15,
said nest means comprising end wall means on said body of said casing,
said nests comprising recesses in said end wall means for receiving portions of the respective terminals.

19. An electrical switch according to claim 18,
said retainer elements comprising projections on said cover for engaging and retaining said terminals in said recesses.

20. An electrical switch according to claim 18,
said retainer elements comprising projections on said cover for extending into portions of said recesses to engage and retain said terminals in said recesses.

21. An electrical switch according to claim 15,
said nest means comprising end wall means on said body,
said nests comprising notches formed in said end wall means for receiving and locating the respective terminals,
said retainer means comprising tooth-like projections on said cover for extending into portions of said notches for engaging and retaining said terminals in said notches.

22. An electrical switch according to claim 21,
said end wall means having inner and outer sides,
each of said terminals having inner and outer locating means for overlapping said inner and outer sides of said end wall means to locate said terminals against substantial endwise movement.

23. An electrical switch according to claim 22,
said terminals having respective flanges constituting said inner locating means,
said terminals having respective lateral projections thereon constituting said outer locating means.

24. An electrical switch according to claim 22,
said terminals having respective flanges constituting said inner locating means,
said terminals having tabs thereon constituting said outer locating means.

25. An electrical switch according to claim 22,
said terminals being generally L-shaped and comprising respective terminal flanges bent from said plates and terminal prongs bent from said terminal flanges,
said terminal prongs being received in the respective notches in said end wall means,
said terminal flanges constituting said inner locating means,
said outer locating means comprising respective lateral projections on said terminal prongs and spaced from said terminal flanges.

26. An electrical switch according to claim 25,
said lateral projections being in the form of tabs projecting from said terminal prongs.

27. An electrical switch, comprising an insulating casing including a body having a supporting wall with inner and outer sides,
said casing also having a cover,
a plurality of fixed contact plates mounted in said casing along the inner side of said supporting wall,
said contact plates having a plurality of fixed contact portions,
an insulating carriage mounted in said casing,
said casing having means for guiding said carriage for movement along a predetermined path,
and at least one electrically conductive contactor mounted on said carriage for movement therewith along said path and for selective engagement with certain of said contact portions,
said supporting wall of said casing having a plurality of slots therein,
said plates having respective first end portions formed as generally L-shaped hooks for reception in said respective slots to retain said first end portions against said supporting wall,
said L-shaped hooks having respective first flange portions bent from said plates and extending through the respective slots,.
said L-shaped hooks having respective second flange portions bent from said first flange portions and extending behind the outer side of said supporting wall to retain said plates against the inner side of said supporting wall,
said contact plates having respective second end portions formed as respective generally L-shaped electrical terminals having respective terminal flanges bent from said plates and respective terminal prongs bent from said terminal flanges,
said body of said casing having end wall means forming respective nests for receiving said respective terminal prongs,
said cover and said body having fastener means for fastening said cover to said body,
said cover having retainer elements for engaging and retaining said terminal prongs in said nests.

28. An electrical switch according to claim 27,
said supporting wall having a plurality of enclosure flanges projecting from the outer side of said supporting wall and extending around said slots and adjacent portions of said outer side to afford electrical insulation for the second flange portions of said L-shaped hooks.

29. An electrical switch according to claim 27,
said nests comprising recesses in said end wall means for receiving portions of the respective terminal prongs,
said retainer elements comprising projections on said cover for engaging and retaining said terminal prongs in said recesses.

30. An electrical switch according to claim 27,
said nests comprising notches formed in said end wall means for receiving and locating the respective terminal prongs,
said retainer means comprising tooth-like projections on said cover for extending into portions of said notches for engaging and retaining said terminal prongs in said notches.

31. An electrical switch according to claim 27,
said end wall means having inner and outer sides,
said terminal flanges constituting inner locating means for overlapping said inner sides of said end wall means,
said terminal prongs having outer locating means thereon for overlapping said outer sides of said end wall means to locate said terminals against substantial endwise movement.

32. An electrical switch according to claim 31,
said outer locating means comprising respective lateral projections on said terminal prongs and spaced from said terminal flanges.

33. An electrical switch according to claim 32,
said lateral projections being in the form of tabs projecting from said terminal prongs.

34. An electrical switch according to claim 27,
said fastener means being in the form of latching snap fastener elements on said cover and said body.

35. An electrical switch, comprising
an insulating casing having a body,
said casing also having a cover and means for fastening said cover to said body,
an insulating carriage movable mounted in said casing,
said cover having a guide slot therein for receiving and guiding said carriage for movement along a predetermined path,
said cover having guide members on opposite sides of said slot,
said carriage having a slide portion projecting through and slidable along said slot,
said slide portion of said carriage having first and second pairs of flanges thereon for overlapping the front sides of said guide members to retain said slide portion in said slot,
said flanges of said first pair being larger than said flanges of said second pair,
said guide members having first and second pairs of notches therein located toward one end of said slot,
said notches of said first pair being larger than said notches of said second pair,
said first and second pairs of notches corresponding in size to said first and second pairs of flanges whereby said flanges are insertable through said notches in a correct orientation while being precluded from insertion in a reversed orientation,
said body having a stop member therein disposed toward said one end of said slot for engagement by said carriage to limit movement of said carriage toward said one end of said slot whereby said first and second flanges are prevented from moving into alignment with said first and second notches after said cover has been mounted on said body so that said slide portion of said carriage is retained in said slot against accidental disassembly,
at least one conductive contactor mounted on said carriage within said casing,
and fixed contact means mounted in said body for selective engagement by said contactor during movement of said contactor with said carriage along said path thereof.

36. An electrical switch according to claim 35,
said contactor having first and second guide tabs thereon,
said carriage having first and second guide slots for slidably receiving said guide tabs for sliding movement in a transverse direction toward and away from said fixed contact means,
resilient biasing means between said carriage and said contactor for resiliently biasing said contactor toward said fixed contact means,
said first guide tab on said contactor being larger than said second guide tab,
said first guide slot in said carriage being correspondingly larger than said second guide slot,
whereby said contactor is polarized on said carriage and is receivable on said carriage in only one correct position while being precluded from being received in an incorrect reversed position.

* * * * *